US008006323B1

(12) United States Patent
Potter

(10) Patent No.: US 8,006,323 B1
(45) Date of Patent: Aug. 30, 2011

(54) TOILET SEAT SYSTEM

(76) Inventor: Greg A. Potter, St. Petersburg, FL (US)

( * ) Notice: Subject to any disclaimer, the term of this patent is extended or adjusted under 35 U.S.C. 154(b) by 1065 days.

(21) Appl. No.: 11/881,686

(22) Filed: Jul. 27, 2007

(51) Int. Cl.
*A47K 13/10* (2006.01)

(52) U.S. Cl. ..... 4/241; 4/246.1

(58) Field of Classification Search ..... 4/241, 246.1
See application file for complete search history.

(56) References Cited

U.S. PATENT DOCUMENTS 657,278 A * 9/1900 Barton ..... 4/409
4,426,743 A * 1/1984 Seabrooke ..... 4/246.3
4,428,083 A * 1/1984 Chuang ..... 4/240
5,435,016 A 7/1995 Smith
5,588,162 A 12/1996 Robinson
5,642,532 A * 7/1997 Morant ..... 4/246.1
5,898,953 A * 5/1999 Paxon ..... 4/248
6,230,335 B1 * 5/2001 Miller ..... 4/237
6,510,562 B1 1/2003 Bae

* cited by examiner

*Primary Examiner* — Gregory L. Huson
*Assistant Examiner* — Karen Younkins

(57) ABSTRACT

A toilet has a seat. Two spaced members each have an upper end with an aperture. A pivot block has a bore. An axle has end sections and a central section. The end sections are received within the apertures. The central section is received within the bore. A housing is attached to the toilet and a coil spring around the axle. The coil spring has first and second ends. The first end is secured within the housing. The second end is in contact with the seat. The coil spring is adapted to urge the toilet seat from a lowered position to a raised position. A locking assembly includes upper and lower fingers. Each finger has a shoulder and a ramp. The upper finger extends downwardly from the toilet seat. The lower finger extends upwardly from the toilet seat. The lower finger is movable between a locking and an unlocking orientation.

4 Claims, 3 Drawing Sheets

FIG 1
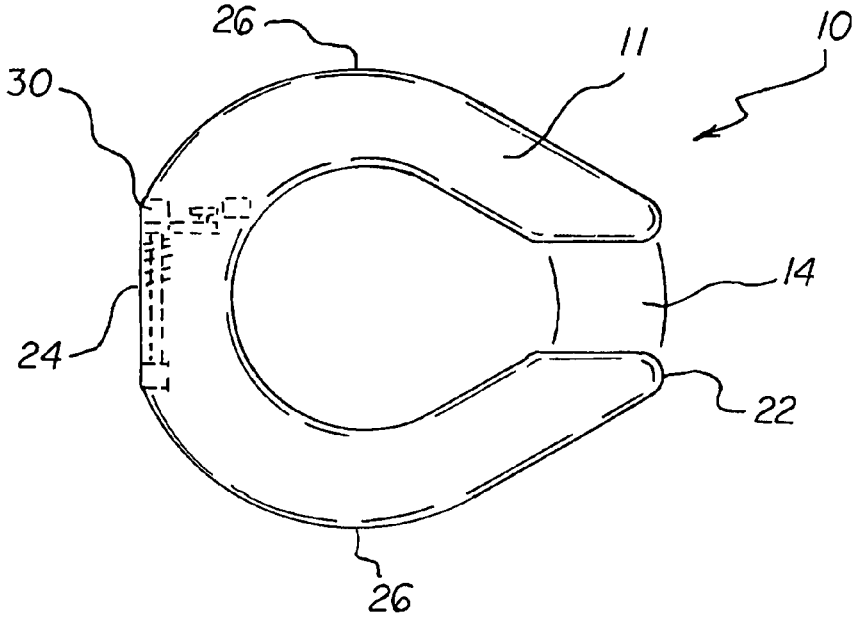
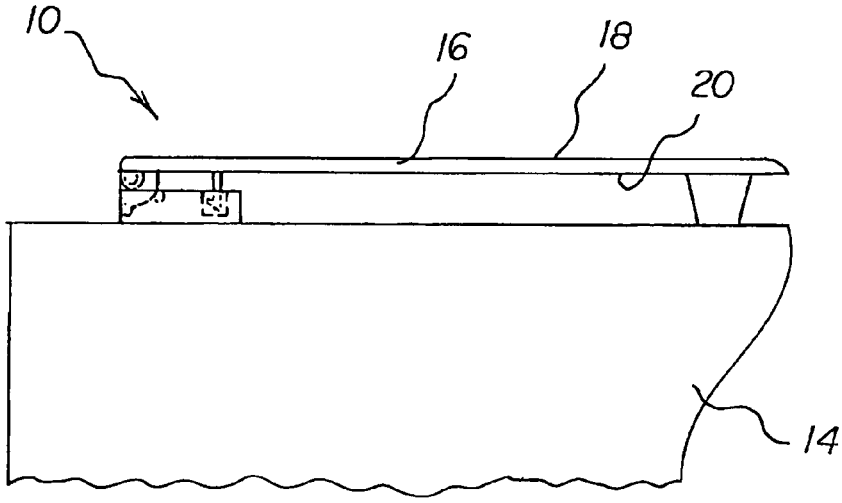
FIG 2

FIG 5
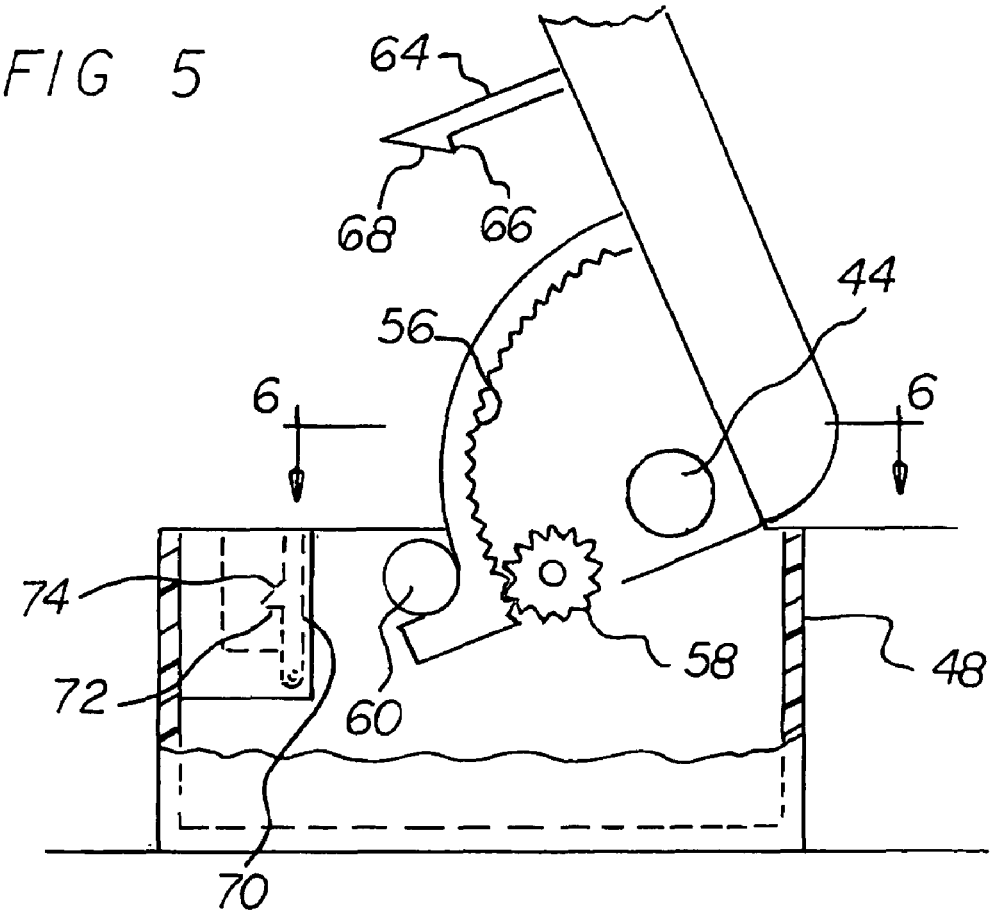
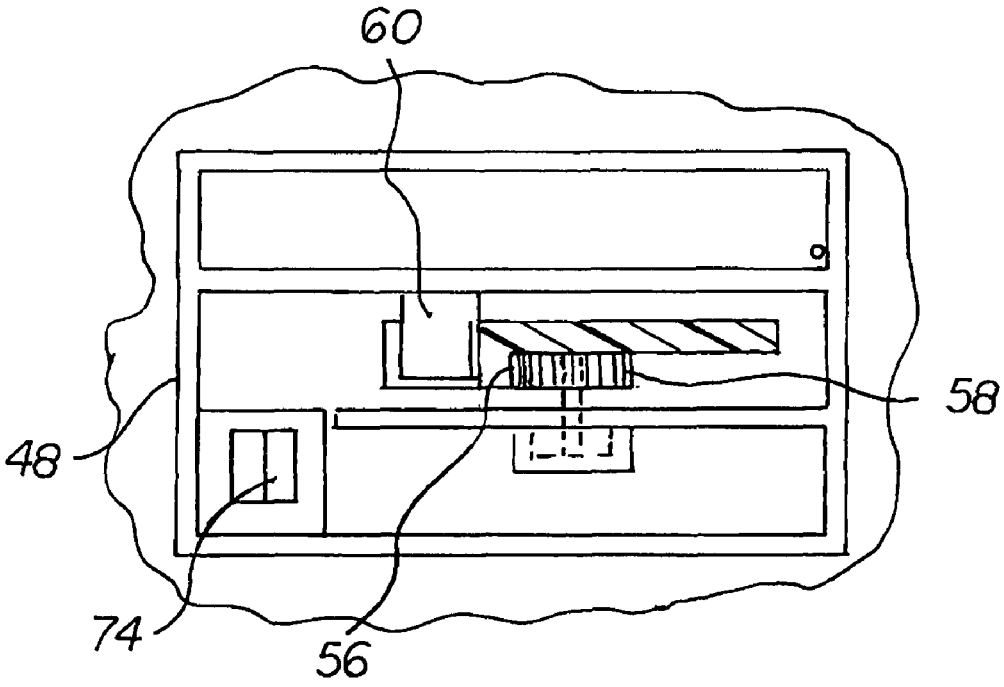
FIG 6

TOILET SEAT SYSTEM

BACKGROUND OF THE INVENTION

1. Field of the Invention

The present invention relates to a toilet seat system and more particularly pertains to locking a seat in a down position and to unlocking a seat when a user sits upon it and to driving it up when a user stands up from it.

2. Description of the Prior Art

The use of toilet seat systems of known designs and configurations is known in the prior art. More specifically, toilet seat systems of known designs and configurations previously devised and utilized for the purpose of raising and lowering a toilet seat through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,510,562 issued Jan. 28, 2003, to Bae discloses a toilet seat lifting device. U.S. Pat. No. 5,588,162 issued Dec. 31, 1996 to Robinson discloses a power actuated toilet seat. Lastly, U.S. Pat. No. 5,435,016 issued Jul. 25, 1995, to Smith discloses a toilet flush handle cover.

While these devices fulfill their respective, particular objectives and requirements, the aforementioned patents do not describe a toilet seat system that allows for locking a seat in a down position and for unlocking a seat when a user sits upon it and driving it up when a user stands up from it.

In this respect, the toilet seat system according to the present invention substantially departs from the conventional concepts and designs of the prior art, and in doing so provides an apparatus primarily developed for the purpose of locking a seat in a down position and unlocking a seat when a user sits upon it and driving it up when a user stands up from it.

Therefore, it can be appreciated that there exists a continuing need for a new and improved toilet seat system which can be used for locking a seat in a down position and for unlocking a seat when a user sits upon it and for driving it up when a user stands up from it. In this regard, the present invention substantially fulfills this need.

SUMMARY OF THE INVENTION

In view of the foregoing disadvantages inherent in the known types of toilet seat systems of known designs and configurations now present in the prior art, the present invention provides an improved toilet seat system. As such, the general purpose of the present invention, which will be described subsequently in greater detail, is to provide a new and improved toilet seat system and method which has all the advantages of the prior art and none of the disadvantages.

To attain this, the present invention essentially comprises a toilet seat system. First provided is a universal public toilet. The toilet has a toilet seat. The seat has an upper surface. The seat has a lower surface. The seat has a generally oval configuration. The seat has a front edge. The seat has a rear edge. The front edge and the rear edge are spaced by a maximum distance of about 18 inches. The seat has side edges. The side edges are provided between the front and rear edges. The side edges are spaced by a maximum distance of about 14 inches.

Two vertically oriented, laterally spaced bolts are provided. Each bolt has a lower end. Each bolt has threads. The threads are provided on the lower end of the bolt. Each bolt is attached to the toilet. Each bolt has an upper end. Each bolt has an aperture. The aperture is provided on the upper end of the bolt. The apertures are horizontally oriented in axial alignment.

Provided next is a pivot block. The pivot block depends from the lower surface of the toilet seat adjacent to the rear edge. A horizontal bore is provided. The horizontal bore extends through the pivot block.

An axle is provided next. The axle has end sections. The end sections of the axle are received within the apertures of the bolts. The axle has a central section. The central section is received within the bore of the pivot block. The spaced bolts and the pivot block and the axle form a hinge assembly. In this manner the seat may pivot with respect to the toilet.

Further provided is a housing. The housing is attached to the toilet between the pivot block and one bolt. The housing has a coil spring. The coil spring is provided around the axle. The coil spring has a first end. The first end is secured within the housing. The coil spring has a second end. The second end is in contact with the toilet seat. The coil spring is adapted to urge the toilet seat from a lowered position to a raised position. The housing has an oscillating gear. The oscillating gear is secured to the seat. In this manner the oscillating gear and seat may move about an axis or rotation coincident with the axis of the axle. The housing has a pinion gear. The pinion gear is mounted for rotation in the housing and with teeth in meshing contact with the oscillating gear. The housing has a guide roller. The guide roller is mounted for rotation in the housing and with a periphery in rolling contact with the oscillating gear. The oscillating gear is provided between the pinion gear and the guide roller. In this manner the force of the coil spring is resisted when the toilet seat is rising. Further in this manner its speed is limited.

Provided last is a locking assembly. The locking assembly includes an upper finger. The upper finger extends downwardly from the lower surface of the toilet seat closer to the rear end than the front end. The upper finger an intermediate shoulder. The upper finger has a lower ramp. The locking assembly further includes a lower finger. The lower finger extends upwardly from within the housing. The lower finger has an intermediate shoulder. The lower finger has a lower ramp. The lower finger is movable between a forward locking orientation and a rearward unlocking orientation. The forward locking orientation features the intermediate shoulder of the upper finger in contact with the intermediate shoulder of the lower finger. The rearward unlocking orientation features the intermediate shoulder of the upper finger spaced from the intermediate shoulder of the lower finger. In this manner the coil spring will drive the toilet seat upwardly. The toilet seat is adapted to be lowered. In this manner the ramp of the upper finger contacts and shifts the ramp of the lower finger. Also in this manner the seat is locked in a down position. Further in this manner the fingers will be separated and unlocked when a user sits upon the seat.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet seat system which has all of the advantages of the prior art toilet seat systems of known designs and configurations and none of the disadvantages.

It is another object of the present invention to provide a new and improved toilet seat system which may be easily and efficiently manufactured and marketed.

It is further object of the present invention to provide a new and improved toilet seat system which is of durable and reliable constructions.

An even further object of the present invention is to provide a new and improved toilet seat system which is susceptible of a low cost of manufacture with regard to both materials and labor, and which accordingly is then susceptible of low prices of sale to the consuming public, thereby making such toilet seat system economically available to the buying public.

Even still another object of the present invention is to provide a toilet seat system for locking a seat in a down position and for unlocking a seat when a user sits upon it and for driving it up when a user stands up from it.

Lastly, it is an object of the present invention to provide a new and improved toilet seat system. A toilet has a seat. Two spaced members each have an upper end with an aperture. A pivot block has a bore. An axle has end sections and a central section. The end sections are received within the apertures. The central section is received within the bore. A housing is attached to the toilet and a coil spring around the axle. The coil spring has first and second ends. The first end is secured within the housing. The second end is in contact with the seat. The coil spring is adapted to urge the toilet seat from a lowered position to a raised position. A locking assembly includes upper and lower fingers. Each finger has a shoulder and a ramp. The upper finger extends downwardly from the toilet seat. The lower finger extends upwardly from the toilet seat. The lower finger is movable between a locking and an unlocking orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a toilet seat system constructed in accordance with the principles of the present invention.

FIG. 2 is a side elevational view of the system with the toilet seat locked in a downward orientation.

FIG. 5 is a cross sectional view of the system taken along line 5-5 of FIG. 4.

FIG. 6 is a cross sectional view of the system taken along line 6-6 of FIG. 5.

The same reference numerals refer to the same parts throughout the various Figures.

DESCRIPTION OF THE PREFERRED EMBODIMENT

Figure 3:
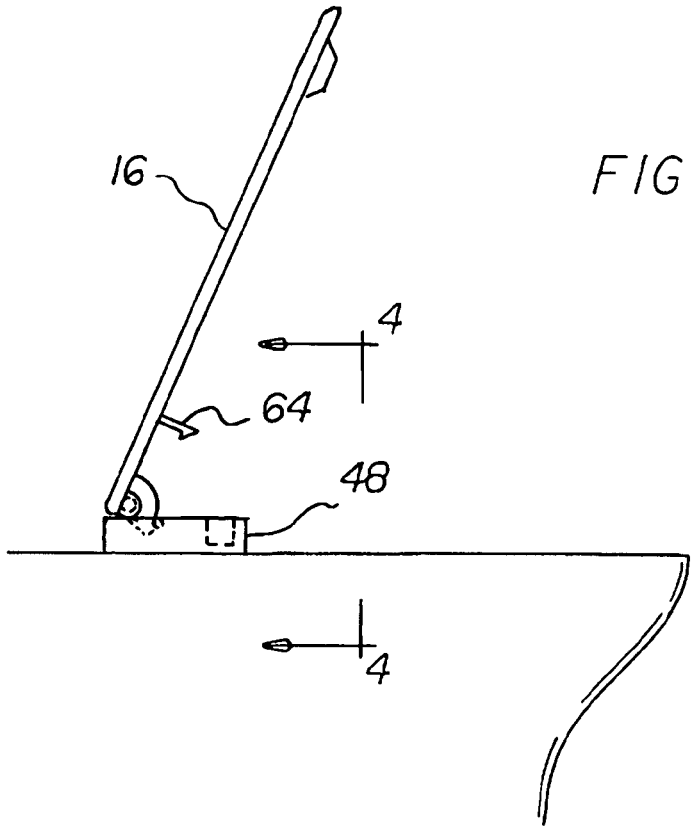
FIG. 3 is a side elevational view of the system with the toilet seat unlocked and in an upward orientation.
Figure 4:
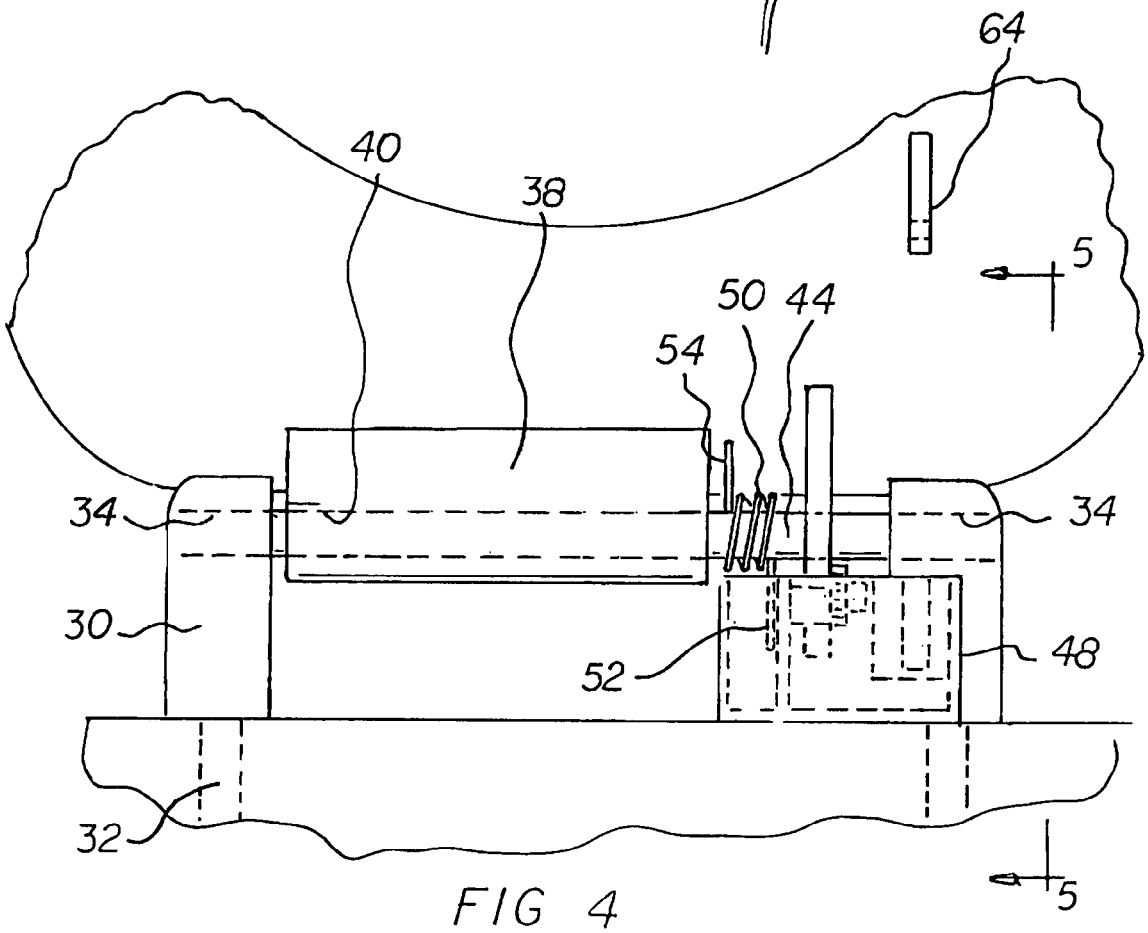
FIG. 4 is a front elevational view of the system taken along line 4-4 of FIG. 3.

With reference now to the drawings, and in particular to FIG. 1 thereof, the preferred embodiment of the new and improved toilet seat system embodying the principles and concepts of the present invention and generally designated by the reference numeral 10 will be described.

The present invention, the toilet seat system 10 is comprised of a plurality of components. Such components in their broadest context include a toilet, two spaced members, a pivot block, an axle, a housing and a locking assembly. Such components are individually configured and correlated with respect to each other so as to attain the desired objective.

First provided is a universal public toilet 14. The toilet has a toilet seat 16. The seat has an upper surface 18. The seat has a lower surface 20. The seat has a generally oval configuration. The seat has a front edge 22. The seat has a rear edge 24. The front edge and the rear edge are spaced by a maximum distance of about 18 inches. The seat has side edges 26. The side edges are provided between the front and rear edges. The side edges are spaced by a maximum distance of about 14 inches.

Two vertically oriented, laterally spaced bolts 30 are provided. Each bolt has a lower end. Each bolt has threads 32. The threads are provided on the lower end of the bolt. Each bolt is attached to the toilet. Each bolt has an upper end. Each bolt has an aperture 34. The aperture is provided on the upper end of the bolt. The apertures are horizontally oriented in axial alignment.

Provided next is a pivot block 38. The pivot block depends from the lower surface of the toilet seat adjacent to the rear edge. A horizontal bore 40 is provided. The horizontal bore extends through the pivot block.

An axle 44 is provided next. The axle has end sections. The end sections of the axle are received within the apertures of the bolts. The axle has a central section. The central section is received within the bore of the pivot block. The spaced bolts and the pivot block and the axle form a hinge assembly. In this manner the seat may pivot with respect to the toilet.

Further provided is a housing 48. The housing is attached to the toilet between the pivot block and one bolt. The housing has a coil spring 50. The coil spring is provided around the axle. The coil spring has a first end 52. The first end is secured within the housing. The coil spring has a second end 54. The second end is in contact with the toilet seat. The coil spring is adapted to urge the toilet seat from a lowered position to a raised position. The housing has an oscillating gear 56. The oscillating gear is secured to the seat. In this manner the oscillating gear and seat may move about an axis or rotation coincident with the axis of the axle. The housing has a pinion gear 58. The pinion gear is mounted for rotation in the housing and with teeth in meshing contact with the oscillating gear. The housing has a guide roller 60. The guide roller is mounted for rotation in the housing and with a periphery in rolling contact with the oscillating gear. The oscillating gear is provided between the pinion gear and the guide roller. In this manner the force of the coil spring is resisted when the toilet seat is rising. Further in this manner its speed is limited.

Provided last is a locking assembly. The locking assembly includes an upper finger 64. The upper finger extends downwardly from the lower surface of the toilet seat closer to the rear end than the front end. The upper finger an intermediate shoulder 66. The upper finger has a lower ramp 68. The locking assembly further includes a lower finger 70. The lower finger extends upwardly from within the housing. The lower finger has an intermediate shoulder 72. The lower finger has a lower ramp 74. The lower finger is movable between a forward locking orientation and a rearward unlocking orientation. The forward locking orientation features the intermediate shoulder of the upper finger in contact with the intermediate shoulder of the lower finger. The rearward unlocking orientation features the intermediate shoulder of the upper finger spaced from the intermediate shoulder of the lower finger. In this manner the coil spring will drive the toilet seat upwardly. The toilet seat is adapted to be lowered. In this manner the ramp of the upper finger contacts and shifts the ramp of the lower finger. Also in this manner the seat is locked in a down position. Further in this manner the fingers will be separated and unlocked when a user sits upon the seat.

Further details of the locking assembly are disclosed in the prior art patents as exemplified by U.S. Pat. No. 2,944,241 issued Jul. 5, 1960 to Londell and in U.S. Pat. No. 4,540,236 issued Sep. 10, 1985 to Peers-Trevarton, the subject matter of which patents is incorporated herein by reference.

We have all been to public restrooms and seen dirty toilet seats sprinkled with urine. It does not matter where you are, be it a restaurant, department store, or just a gas station, everyone hates to have to wipe down and sit on an unclean public toilet seat.

The present invention is a modification to the existing toilet seat and seat hinge. The concept is simple. If the seat is up, then the people with "bad aim" will not get urine on the seat. The present invention is a hinge that when the seat is put in the down position, it will stay down. But, once the seat has been sat on, it will unlock so that once you stand back up, it will rise back to the upright position in a slow and steady manner so as not to slap the backside of the person using it. In this manner, the seat will only be down when someone is sitting on its and will be upright when someone is urinating. Toilets and toilet seats have a universal fit worldwide. This seat will fit any public toilet anywhere in the world. This is intended for public toilet seats.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seat system comprising:

a toilet with a toilet seat;

two spaced members each having an upper end with an aperture;

a pivot block with a bore;

an axle having end sections received within the apertures and a central section received within the bore;

a housing attached to the toilet and a coil spring around the axle with a first end secured within the housing and a second end in contact with the toilet seat adapted to urge the toilet seat from a lowered position to a raised position; and a locking assembly including an upper finger extending downwardly from the toilet seat with a shoulder and a ramp and a lower finger extending upwardly from the housing having a shoulder and a ramp, the lower finger being movable between a locking and an unlocking orientation.

2. The system as set forth in claim 1 wherein a forward locking orientation features the intermediate shoulder of an upper finger in contact with an intermediate shoulder of the lower finger, a rearward unlocking orientation features the intermediate shoulder of the upper finger being spaced from the intermediate shoulder of the lower finger whereby the coil spring will drive the toilet seat upwardly, where after the toilet seat is adapted to be lowered so that the ramp of the upper finger contacts and shifts the ramp of the lower finger whereby the seat is locked in a down position, where after the fingers will be separated and unlocked when a user sits upon the seat.

3. The system as set forth in claim 1 and further including:

an oscillating gear secured to the seat for movement therewith about an axis of rotation coincident with an axis of the axle, a pinion gear mounted for rotation in the housing and with teeth in meshing contact with the oscillating gear, a guide roller mounted for rotation in the housing and with a periphery in rolling contact with the oscillating gear with the oscillating gear between the pinion gear and the guide roller to resist force of the coil spring when the toilet seat is rising.

4. A toilet seat system for locking a seat in a down position and for unlocking a seat when a user sits upon it and driving it up when a user stands up from it comprising, in combination:

a universal public toilet with a toilet seat, the seat having an upper surface and a lower surface, the seat having a generally oval configuration with a front edge and a rear edge spaced by a maximum distance of about 18 inches with side edges between the front and rear edges spaced by a maximum distance of about 14 inches;

two vertically oriented, laterally spaced bolts, each bolt having a lower end with threads attached to the toilet, each bolt having an upper end with an aperture, the apertures being horizontally oriented in axial alignment;

a pivot block depending from the lower surface of the toilet seat adjacent to the rear edge with a horizontal bore extending through the pivot block;

an axle having end sections received within the apertures of the bolts and a central section received within the bore of the pivot block, the spaced bolts and the pivot block and the axle forming a hinge assembly for pivoting the seat with respect to the toilet;

a housing attached to the toilet between the pivot block and one bolt, a coil spring around the axle with a first end secured within the housing and a second end in contact with the toilet seat, the coil spring adapted to urge the toilet seat from a lowered position to a raised position, an oscillating gear secured to the seat for movement therewith about an axis or rotation coincident with the axis of the axle, a pinion gear mounted for rotation in the housing and with teeth in meshing contact with the oscillating gear, a guide roller mounted for rotation in the housing and with a periphery in rolling contact with the oscillating gear with the oscillating gear between the pinion gear and the guide roller to resist the force of the coil spring when the toilet seat is rising for limiting its speed; and a locking assembly including an upper finger extending downwardly from the lower surface of the toilet seat closer to the rear end than the front end, the finger having an intermediate shoulder and a lower ramp, a lower finger extending upwardly from within the housing, the lower finger having an intermediate shoulder and a lower ramp, the lower finger being movable between a forward locking orientation and a rearward unlocking orientation, the forward locking orientation featuring the intermediate shoulder of the upper finger in contact with the intermediate shoulder of the lower finger, the rearward unlocking orientation featuring the intermediate shoulder of the upper finger being spaced from the intermediate shoulder of the lower finger whereby the coil spring will drive the toilet seat upwardly, where after the toilet seat is adapted to be lowered so that the ramp of the upper finger contacts and shifts the ramp of the lower finger whereby the seat is locked in a down position, where after the fingers will be separated and unlocked when a user sits upon the seat.

* * * * *